United States Patent [19]

Goffinet et al.

[11] 4,155,855

[45] May 22, 1979

[54] CONCENTRATED LIQUID FABRIC SOFTENER COMPOSITION

[75] Inventors: Pierre C. E. Goffinet, Brussels; Brian A. Brown, Tervuren, both of Belgium

[73] Assignee: The Procter & Gamble Company, Cincinnati, Ohio

[21] Appl. No.: 919,204

[22] Filed: Jun. 26, 1978

[51] Int. Cl.[2] ..... D06M 13/34

[52] U.S. Cl. ..... 252/8.8; 8/115.6

[58] Field of Search ..... 252/8.8 R, 8.8 AA, 8.8 T, 252/8.8 U, 8.8 AE; 8/115.6; 260/584 B, 583 P

[56] References Cited

U.S. PATENT DOCUMENTS

| | | | |
|---|---|---|---|
| 3,069,422 | 12/1962 | Fitzpatrick et al. | 252/8.8 |
| 3,069,428 | 12/1962 | Fitzpatrick et al. | 252/8.8 |
| 3,080,259 | 3/1963 | Lafleur | 252/8.8 |
| 3,108,011 | 10/1963 | Frotscher | 252/8.8 |
| 3,775,316 | 11/1973 | Berg et al. | 252/8.8 |
| 4,049,557 | 9/1977 | Wixon | 252/8.8 |
| 4,092,253 | 5/1978 | Cuntze et al. | 8/115.6 |

*Primary Examiner*—William E. Schulz

[57] ABSTRACT

Concentrated liquid fabric softeners containing a fabric substantive agent, inclusive of polyamines and alkylpyridinium salts, in conjunction with a fabric softening component, inclusive of quaternary ammonium salts; alkylimidazolinium salts; fatty esters; fatty ethers; and fatty compounds containing a sulfur or nitrogen linking atom, are disclosed. The subject concentrated softener compositions are easily dispersible in aqueous medium and thus can evenly deposit onto fibers to thereby provide textile handling benefits inclusive of softening, static control, ease-of-ironing, fluffiness, pliability and smoothness.

15 Claims, No Drawings

CONCENTRATED LIQUID FABRIC SOFTENER COMPOSITION

This invention pertains to concentrated liquid fabric softener compositions comprising a fabric substantive agent in conjunction with a fabric softening component. The fabric substantive agent is selected from polyamines, alkylpyridinium salts and mixtures thereof. The fabric softening component can be represented by quaternary ammonium salts, alkylimidazolinium salts, fatty esters, ethers of fatty alcohols, fatty compounds which are interrupted by a sulfur or a nitrogen atom, and mixtures thereof. In preferred composition herein, the fabric softening component is represented by a mixture of a quaternary ammonium salt and an additional fabric softening component selected from fatty esters, ethers of fatty alcohols and fatty compounds containing a long alkyl chain which are interrupted by a sulfur or nitrogen atom.

The concentrated liquid softeners of this invention, in addition to easy pourability and water dispersability, provide a series of important advantages inclusive of: consumer convenience in transport, storage and usage flexibility inasmuch as housewives are not any longer limited in selecting "their" degree of softeness by the capacity of the fabric softener dispenser in automatic washing machines. Another convenience aspect relates to the possibility now offered to the consumer to either utilize a concentrated product as such or to utilize it in a conventional concentration after predilution.

Although it was well recognized that concentrated fabric softener compositions could provide convenience and utilization facilities to housewives, as of yet no technical solutions could be made available to overcome known deficiencies, especially, pourability and water dispersability, inherent to conventional products containing more than about 10 to 12% active materials. Attempts have been undertaken to solve these problems through the use of electrolytes, inclusive of calcium chloride in e.g. levels up to 2000 ppm. However, such remedies have not provided a satisfactory solution to the problems inasmuch as all that can be achieved is to possibly incorporate a few percent more actives into conventional liquid fabric softeners. However, the prior art does not provide a solution to formulate a commercially viable liquid rinse-softener product containing active ingredient levels as claimed herein, or more broadly above about 15%, which do not have the physical appearance and use shortcomings set forth above.

It is a main object of this invention to provide concentrated fabric softener compositions having pourability and water-dispersability properties which are substantially comparable to liquid softeners having conventional active concentration ranges i.e. from about 3 to about 10% by weight.

It is a further object of this invention to provide a liquid concentrated softener composition the physical aspects of which resemble conventional low-active softeners and which is not subject to any phase-stability or other deficiencies which can develop during prolonged storage.

The above and other objects of this invention can now be obtained through the combined use of a fabric-substantive agent and a fabric-softening component in defined ranges as can be seen from the following description of the invention.

SUMMARY OF THE INVENTION

It has now been discovered that concentrated liquid fabric softeners can be prepared which are capable of providing a series of convenience, usage and, generally, economical advantages.

The concentrated compositions herein comprise: from about 25% to about 55% by weight of an active system containing a fabric-substantive agent and a fabric-softening component, the fabric-substantive agent being selected from the group of:

(1) a compound having the formula

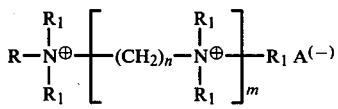

wherein R is selected from an alkyl or alkenyl group having from 10 to 24 carbon atoms in the alk(en)yl chain, and $R\text{-}O(CH_2)_{n1}$—; the $R_1$'s which may be the same or different each represent hydrogen, $—(C_2H_4O)_pH$, $—(C_3H_6O)_qH$, $—(C_2H_4O)_{p'}(C_3H_6O)_{q'}H$, a $C_{1-3}$ alkyl group or the group $—(CH_2)_{n2}—N(R')_2$, wherein R' is selected from hydrogen, $—(C_2H_4O)_pH$, $—(C_3H_6O)_qH$, $—(C_2H_4O)_{p'}(C_3H_6O)_{q'}H$ and a $C_{1-3}$ alkyl group, where n, $n_1$ and $n_2$ each represent an integer from 2 to 6, m is an integer from 1 to 5, each p, q and (p'+q') may be 0 or a number such that (p+q+p'+q') does not exceed 25, and, if in the salt or partial salt form, $A^{(-)}$ represents one or more anions having total charge balancing that of the nitrogen atom(s);

(2) an alkylpyridinium salt wherein the alkyl chain has from about 10 to 24 carbon atoms; and (3) mixtures thereof; with the proviso that the fabric-substantive agent has a water-solubility of more than about 5% by weight at pH 2.5 and 20° C., the fabric-softening component being selected from the group of (a) a quaternary ammonium salt having the formula

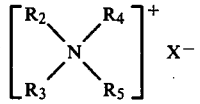

wherein $R_2$ and $R_3$ represent hydrocarbyl groups having from 12 to 24 carbon atoms, $R_4$ and $R_5$ represent hydrocarbyl groups having from 1 to 4 carbon atoms, and X is an anion;

(b) an alkylimidazolinium salt having the formula

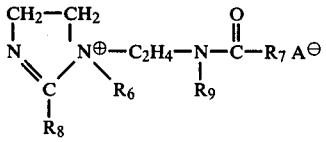

wherein $R_6$ is a $C_{1-4}$ alkyl group, $R_9$ is hydrogen or a $C_{1-4}$ alkyl group, $R_8$ is a $C_{8-25}$ alkyl group; and $R_7$ is a $C_{9-25}$ alkyl group; and $A^{\ominus}$ is an anion;

(c) a fatty ester of mono- or polyhydric alcohols having from 1 to about 24 carbon atoms in the hydrocarbon chain, and mono- or polycarboxylic acids having from 1 to about 24 carbon atoms in the hydrocarbon chain with the provisos that the total number of carbon atoms in the ester is equal to or greater than 16 and that at least one of the hydrocarbon radicals in the ester has 12 or more carbon atoms;

(d) ethers of fatty alcohols having from 10 to 24 carbon atoms in the alkyl chain and mono- or polyalcohols having from 2 to 8 carbon atoms, whereby the total number of carbon atoms in the ether is equal to or greater than 16;

(e) compounds of the formula $R_{10}$—X—$R_{11}$ wherein $R_{10}$ has from about 12 to 24 carbon atoms and $R_{11}$ from 1 to 6 carbon atoms in the alkyl chain which can be interrupted by not more than one oxygen link, and X stands for sulfur, $$-\underset{\underset{O}{\|}}{C}-NH-;\ \text{or}\ -NH-\underset{\underset{O}{\|}}{C}-;$$

and (f) mixtures thereof, whereby the weight of the fabric-substantive agent to the fabric-softening component is in the range from about 6:1 to about 1:4; and a liquid carrier.

The preferred fabric-substantive agent herein can be represented by alkoxylated diamines. Preferred compositions contain a ternary active system comprising the polyamines in combination with a mixture of two fabric softening components namely a first cationic softening component selected from the quaternary ammonium salt and the alkylimidazolinium salt and an additional nonionic softening component selected from fatty esters, ethers of fatty alcohols and fatty compounds containing a long-alkyl chain and a non-terminal amide group. In such preferred compositions, the cationic softening component represents less than half of the total mixture of the cationic softening component and the nonionic softening component.

DETAILED DESCRIPTION OF THE INVENTION

The concentrated liquid softener composition of this invention comprises a fabric-substantive agent and a fabric softener component. The fabric-substantive agent can be represented by polyamines, alkylpyridinium salts and mixtures thereof. The fabric-softening component can be represented by quaternary ammonium salts, alkylimidazolinium salts, a series of nonionic softening components, and mixtures thereof. The individual ingredients are described in more detail hereinafter.

Unless indicated to the contrary, the "%" indications stand for percent by weight.

A first essential component herein is a fabric-substantive agent selected from the group of specific polyamines, alkylpyridinium salts and mixtures thereof. The polyamine component has the formula:

$$R-\overset{\overset{R_1}{|}}{\underset{\underset{R_1}{|}}{N^{\oplus}}}-\left[(CH_2)_n-\overset{\overset{R_1}{|}}{\underset{\underset{R_1}{|}}{N^{\oplus}}}\right]_m-R_1\ A^{(-)}$$

wherein R is selected from an alkyl or alkenyl group having from 10 to 24, preferably from 16 to 20 carbon atoms in the alk(en)yl chain, and R—O—$(CH_2)_{n1}$—; the $R_1$'s which may be the same or different each represent hydrogen, —$(C_2H_4O)_pH$, —$(C_3H_6O)_qH$, —$(C_2H_4O)_{p'}(C_3H_6O)_{q'}H$, a $C_{1-3}$ alkyl group or the group-$(CH_2)_{n2}$-$N(R')_2$, wherein R' is selected from hydrogen, —$(C_2H_4O)_pH$, —$(C_3H_6O)_qH$, —$(C_2H_4O)_{p'}(C_3H_6O)_{q'}H$ and a $C_{1-3}$ alkyl group, where n, $n_1$ and $n_2$ each represent an integer from 2 to 6, preferably 2 or 3, m is an integer from 1 to 5, preferably 1 or 2, each p, q, and (p'+q') may be 0 or a number such that (p+q+p'+q') does not exceed 25. Preferably, each p, q and (p'+q') are 1 or 2. If in the salt or partial salt form, $A^{\ominus}$ represents one or more anions having total charge balancing that of the nitrogen atom(s).

Preferred fabric-substantive polyamines contain not more than one —$C_2H_4OH$, —$C_3H_6OH$, or —$(C_2H_4O)(C_3H_6O)H$ group attached to each nitrogen atom, except that up to two of these monomeric groups (in this context, the mixed oxyethylene/oxypropylene radical containing 1 mole of each of the monomers is equally defined as a monomer), can be attached to a terminal nitrogen atom which is not substituted by an alkyl group having from 10 to 24 carbon atoms.

Polyamine species suitable for use herein include:

N-tallowyl,N,N',N'-tris(2-hydroxyethyl)1,3-propanediamine di-hydrochloride;

N-soybean alkyl-1,3-propane diammonium sulfate;

N-stearyl-N,N'-di(2-hydroxyethyl)-N'-(3-hydroxypropyl)-1,3-propanediamine dihydrofluoride;

N-cocoyl N,N,N',N',N'-pentamethyl-1,3-propane diammonium dichloride or dimethosulfate;

N-oleyl N,N',N'-tris(3-hydroxypropyl)-1,3-propanediamine dihydrofluoride;

N-stearyl N,N',N'-tris(2-hydroxyethyl) N,N'-dimethyl-1,3-propanediammonium dimethylsulfate;

N-palmityl N,N',N'-tris(3-hydroxypropyl)-1,3-propanediamine dihydrobromide;

N-(stearyloxypropyl) N,N',N'-tris(3-hydroxypropyl)1,3-propanediammonium diacetate;

N-tallowyl N-(3-aminopropyl)1,3-propanediamine trihydrochloride;

N-oleyl N-[N'',N''-bis(2-hydroxyethyl)3-aminopropyl]N',N'-bis(2-hydroxyethyl)1,3 diaminopropane trihydrofluoride.

It is understood that the polyamines can also be represented by components comprising a heterocyclic moiety resulting from internal cyclization of the polyamines having the general formula indicated above. The cyclization can be produced in reacting the polyamines with formic acid followed by thermal dehydration. Typical examples of suitable polyamines containing such a heterocyclic moiety are: 1-[N-hydrogenated tallowylaminopropyl]-pentahydropyridinium dihydrochloride; 1-[N-stearylaminopropyl]-5-(hydroxyethyl)-tetrahydropyridinium sulfate.

Preferred species frequently contain an ethylene oxyde or propylene oxide radical condensed on one or more of the nitrogen atoms of the polyamine. The most preferred species contain one ethylene oxide or one propylene oxide group directly condensed onto each nitrogen atom.

$A^{(-)}$ may represent a halide or any appropriate acidic radical such as a di-acetate, or higher saturated or unsaturated acyl groups up to $C_{22}$, and more in general all nitrogen charge balancing anions which are known to be suitable for use in these compositions. Preferred nitrogen charge balancing anions can be represented by halides, $C_{1-22}$ alkyl, $C_1$-$C_{16}$ alkylaryl, arylsulf(on)ates, arylcarboxylates and $C_1$-$C_{12}$ alkylcarboxylates. Examples of the preferred charge balancing anions include: fluoride, bromide, chloride, methyl sulfate, toluene-, xylene-, cumene-, and benzene-sulfonate, dodecylbenzenesulfonate, benzoate, parahydroxybenzoate, acetate, propionate and laurate.

The fabric substantive agent herein can also be represented by alkyl pyridinium salts having the following formula

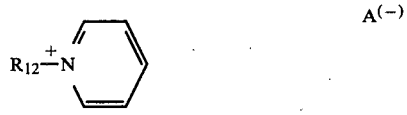

wherein $R_{12}$ is a $C_{10}$–$C_{24}$, preferably $C_{16}$ or $C_{18}$ alkyl radical, and $A^{(-)}$ is a suitable anion as defined hereinbefore, preferably a halide, especially chloride and bromide.

Individual species of the fabric-substantive agent can be used as well as mixtures thereof. For example, a combination of differently substituted mixtures of polyamines can be used or a mixture of polyamine(s) and alkylpyridinium salts.

Suitable fabric-substantive agents herein are additionally characterized by a water-solubility of more than about 5% at pH 2.5 and 20° C.

A second essential ingredient in the compositions of this invention is a fabric-softening component selected from the group of: quaternary ammonium salts; alkylimidazolinium salts; fatty esters; fatty ethers; fatty compounds containing a sulfur or nitrogen linking atom and mixtures thereof.

The quaternary ammonium salt has the formula

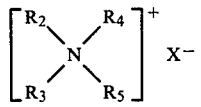

wherein $R_2$ and $R_3$ represent hydrocarbyl groups having from 12 to 24, preferably from 16 to 22 carbon atoms, $R_4$ and $R_5$ represent hydrocarbyl groups having from 1 to 4 carbon atoms, and X is an anion, preferably selected from halide and methylsulfate.

Representative examples of quaternary ammonium salts herein include ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; dihexadecyl dimethyl ammonium bromide; ditallow dipropyl ammonium bromide; di(coconutalkyl)dimethyl ammonium chloride. Ditallow dimethyl ammonium chloride, di(hydrogenated tallow-alkyl) dimethyl ammonium chloride and di(coconut-alkyl) dimethyl ammonium chloride are preferred.

The alkylimidazolinium salts herein have the formula

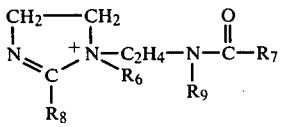

wherein $R_6$ is an alkyl containing from 1 to 4, preferably 1 or 2 carbon atoms, $R_7$ is an alkyl containing from 9 to 25 carbon atoms, $R_8$ is an alkyl containing from 8 to 25 carbon atoms, and $R_9$ is hydrogen or an alkyl containing from 1 to 4 carbon atoms. Preferred imidazolinium salts include 1-methyl-1-[(tallowylamido-)ethyl]-2-tallowyl-4,5-dihydroimidazolinium methyl sulfate--commercially available under the trade name VARISOFT 475, from ASHLAND CHEMICAL Company--and 1-methyl-1-[(palmitoylamido)ethyl]-2-octadecyl-4,5-dihydroimidazolinium chloride. Also suitable herein are the imidazolinium fabric softening components of U.S. Patent application Ser. No. 687,951 to Pracht and Nirschl, incorporated herein by reference. $A^-$ is an anion having the meaning given above, preferably a halide or a methosulfate.

Suitable fatty esters herein are derived from mono- or polyhydric alcohols having from 1 to about 24 carbon atoms in the hydrocarbon chain, and mono- or polycarboxylic acids having from 1 to about 24 carbon atoms in the hydrocarbon chain with the provisos that the total number of carbon atoms in the ester is equal to or greater than 16 and that at least one of the hydrocarbon radicals in the ester has 12 or more carbon atoms.

The fatty acid portion of the fatty ester can be obtained from mono- or polycarboxylic acids having from 1 to about 24 carbon atoms in the hydrocarbon chain. Suitable examples of monocarboxylic fatty acids include behenic acid, stearic acid, oleic acid, palmitic acid, myristic acid, lauric acid, acetic acid, propionic acid, butyric acid, isobutyric acid, valeric acid, lactic acid, glycolic acid and $\beta,\beta''$-dihydroxyisobutyric acid. Examples of suitable polycarboxylic acids include: n-butyl-malonic acid, isocitric acid, citric acid, maleic acid, malic acid and succinic acid.

The fatty alcohol radical in the fatty ester can be represented by mono- or polyhydric alcohols having from 1 to 24 carbon atoms in the hydrocarbon chain. Examples of suitable fatty alcohols include: behenyl, arachidyl, cocoyl, oleyl and lauryl alcohol, ethylene glycol, glycerol, ethanol, isopropanol, vinyl alcohol, diglycerol, xylitol, sucrose, erythritol, pentaerythritol, sorbitol or sorbitan.

Preferred fatty esters herein are ethylene glycol, glycerol and sorbitan esters wherein the fatty acid portion of the ester normally comprises a species selected from behenic acid, stearic acid, oleic acid, palmitic acid or myristic acid.

Sorbitol, prepared by catalytic hydrogenation of glucose, can be dehydrated in well-known fashion to form mixture of 1,4 and 1,5-sorbitol anhydrides and small amounts of isosorbides. (See Brown, U.S. Pat. No. 2,322,821, issued June 29, 1943). This mixture of sorbitol anhydrides is collectively referred to as sorbitan. The sorbitan mixture will also contain some free, uncyclized sorbitol.

Sorbitan esters useful herein can be prepared by esterifying the "sorbitan" mixture with a fatty acyl group in standard fashion, e.g., by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions. Esterified hydroxyl groups can, of course, be either in terminal or internal positions within the sorbitan molecule.

It is also to be recognized that the sorbitan esters employed herein can contain up to about 15% by weight of esters of the $C_{20}$–$C_{26}$, and higher, fatty acids, as well as minor amounts of $C_8$, and lower, fatty esters.

The presence or absence of such contaminants is of no consequence in the present invention.

The glycerol esters are also highly preferred. These are the mono-, di- or tri-esters of glycerol and the fatty acids as defined above.

Specific examples of fatty alcohol esters for use herein include: stearyl acetate, palmityl di-lactate, cocoyl isobutyrate, oleyl maleate, oleyl dimaleate, and tallowyl propionate. Fatty acid esters useful in the present invention include: xylitol monopalmitate, pentaerythritol monostearate, sucrose monostearate, glycerol monostearate, ethylene glycol monostearate and sorbitan esters. Suitable sorbitan esters include sorbitan monostearate, sorbitan palmitate, sorbitan monolaurate, sorbitan monomyristate, sorbitan monobehenate, sorbitan monooleate, sorbitan dilaurate, sorbitan distearate, sorbitan dibehate, sorbitan dioleate, and also mixed tallowalkyl sorbitan mono- and di-esters. Glycerol esters are equally highly preferred in the composition herein. These are the mono-, di-, or tri-esters of glycerol and the fatty acids of the class described above. Glycerol monostearate, glycerol monooleate, glycerol monopalmitate, glycerol monobehenate, and glycerol distearate are specific examples of these preferred glycerol esters.

The fatty esters used herein contain a number of carbon atoms equal to or greater than 16; normally, the fatty esters contain at least one alkyl radical having 12 or more carbon atoms.

The esters of fatty alcohol have from 10 to 24, preferably from 16 to 22 carbon atoms, in the fatty alcohol group and from 2 to about 8 carbon atoms in the etherifying moiety. Suitable fatty alcohols are of natural or synthetic origin and include behenyl, arachidyl, cocoyl, oleyl, lauryl, myristyl and palmityl alcohol. The etherifying moiety can be represented mono- or polyalcohols and by alkylene oxides having preferably a degree of polymerization of not more than 2. Examples of suitable species include: ethylene glycol, glycerol, ethanol, isopropanol, vinyl alcohol, diethyleneglycol, di(propylene oxide), sorbital, ethoxypropylene oxide and pentaerythritol.

The total number of carbon atoms in the ether is equal to or greater than 16.

Specific examples of fatty alcohol mono-ethers are: batyl alcohol (stearyl glycerol mono-ether), behenyl ethyleneglycol monoether, octadecyl vinyl ether, cocoyl sorbital mono-ether, tallowyl diethyleneglycol ether, palmityloxypropyloxypropanol, and arachidylpentaerythritol monoether.

The fabric softening component can also be represented by a compound having the formula: $R_{10}$—X—$R_{11}$ wherein $R_{10}$ has from about 12 to 24, preferably from 16 to 22 carbon atoms and $R_{11}$ from 1 to about 6 carbon atoms in the alkyl chain which can be interrupted by not more than one oxygen link and X stands for sulfur, $$-NH.\overset{O}{\overset{\|}{C}}-, \text{ and } -\underset{O}{\underset{\|}{C}}-NH- .$$

Suitable examples of this compound include: N-stearyl methacrylamide, stearyl vinyl sulfide, N-palmityl-2-hydroxyethylamide, and N-tallowyl-3-hydroxypropylamide.

The liquid fabric softener compositions of this invention contain from about 25% to about 55% of an active system comprising the fabric sustantive agent and the fabric softening component, described in more detail hereinbelow, in a weight ratio of about 6:1 to 1:4. The fabric sustantive agent represents from about 25% to about 85% and the fabric softening component from about 15% to about 75%, the amounts being expressed by reference to the sum of fabric substantive agent and fabric softening component. In a preferred aspect of this invention, the fabric substantive agent represents from about 50% to about 85%, preferably from 65% to 80% and the fabric softening component selected from the quaternary ammonium salt and the alkyl imidazolinium salt --herinafter termed cationic softening component--represents from 15% to 50%, preferably from 35% to 20%. In another aspect of this invention, the fabric substantive agent represents from about 35% to about 65% and the fabric softening component selected from the fatty esters, the ethers of fatty alcohols and fatty compounds containing sulfur or nitrogen linking atoms--hereinafter termed nonionic softening component--represents from 35% to 65%.

In a preferred execution, the fabric softener composition herein is comprised of a ternary active system namely: the fabric substantive agent and a binary fabric softening component system containing a cationic softening component (thus selected from a quaternary ammonium salt and an alkyl imidazolinium salt) and a nonionic softening component (thus selected from fatty esters, fatty esters, and fatty compounds containing a sulfur or nitrogen linking atom). This preferred ternary active mixture contains from about 25% to about 65%, more preferably from 30% to 45% of the fabric substantive agent, from about 8% to about 35%, more preferably from 15% to 25% of the cationic softening component, and from about 15% to about 60%, more preferably from 30% to 55% of the nonionic softening component. In the preferred ternary executions, the weight ratio of the cationic softening component to the nonionic softening component is equal to or smaller than 1 ($\leqq 1$), preferably $\leqq 0.7$.

In additon to the above essential components, the compositions herein may contain other textile treatment or conditioning agents. Such agents include silicons, as for example, described in German patent application DOS 26 31 419 incorporated herein by reference.

The optional silicone component can be used in an amount of from about 0.1% to about 4%, preferably from 0.3% to 3% of the softener composition. In other preferred executions of this invention, the weight ratio of the sum of fabric softening component and silicone to total fabric substantive agent is in the range from 2:1 to 1:3.

The compositions herein can contain optional ingredients which are known to be suitable for use in textile softeners at usual levels for thier known function. Such adjuvants include emulsifers, perfumes, preservatives, germicides, viscosity modifiers, colorants, dyes, fungicides, stabilizers, brighteners, and opacifiers. These adjuvants, if used, are normally added at their conventional low levels (e.g., from about 0.1% to 5% by weight).

The polyamine fabric-substantive agent herein delivers the claimed advantages in either fully neutralized or only partly protonated form. The compositions of this invention have normally a pH below about 7.5, preferably in the range from 2.5 to 6.0.

The compositions can normally be prepared by mixing the ingredients together in water, heating to a temperature of about 60° C. and agitating for 5–30 minutes.

The ternary compositions containing a cationic and a nonionic softening component are preferably prepared in first melting the nonionic softening component followed by dispersing under stirring the fabric substantive agent and the cationic softening component in the molten nonionic softening component. The active mix is then dispersed in the aqueous seat, containing if needed a pH regulator.

Normally, at 60° C., the subject softening agents exist in liquid form and therefore form true emulsions with an aqueous continuous phase. On cooling, the disperse phase may wholly or partially solidify so that the final composition exists as a dispersion which is not a true liquid/liquid emulsion. It will be understood that the term "dispersion" means liquid/liquid phase or solid/-liquid phase dispersions and emulsions.

The following experimental evidence serves to illustrate the invention and to facilitate its understanding.

EXAMPLE I

A concentrated liquid fabric softener was prepared having the composition listed hereinafter. The glycerol monostearate was molten at 65° C. The ditallowdimethylammoniumchloride and the N-tallowyl-N,N', N'-tri(2-hydroxyethyl)-1,3propane diamine (unneutralized) were dispersed, under stirring, in the molten glycerolmonostearate to thus form the (molten) active material premix. The (active material) premix was thereafter dispersed under vigorous stirring in a waterseat having a temperature of about 60° C. Prior to adding the premix, hydrochloric acid and minor ingredients were added to the waterseat to adjust the pH of the liquid softener composition to 4.5 (measured at 20° C.).

| INGREDIENTS | PARTS BY WEIGHT |
|---|---|
| N-tallowyl-N,N',N'-tri(2-hydroxyethyl)-1,3-propanediamine dihydrochloride | 12 |
| Ditallowyldimethylammoniumchloride | 4 |
| Glycerolmonostearate | 16 |
| Water and minor ingredients | balance to 100 |
| pH of composition as is at 22° C.:5 | |

The concentrated composition of this invention was easily pourable at ambient temperature after preparation and after a prolonged storage.

This composition showed excellent phase stability and homogeneity after a 2 weeks storage.

This composition also showed excellent fabric rinse-softener properties either on adding to the rinse in its concentrated form thereby reducing the quantity to be added to thus take into account the higher level of actives, or after predilution to the usual liquid rinse softener concentration (5% to 8%).

Substantially comparable fabric-softener performance can be obtained from the composition of example I where N-tallowyl-N,N', N'-tri(2-hydroxyethyl)-1,3 propanediamine is replaced with a substantially equivalent amount of a polyamine selected from the group of:

N-soybean alkyl-1,3-propane diammonium sulfate;
N-stearyl-N,N'-di(2-hydroxyethyl)-N'-(3-hydroxypropyl)-1,3-propanediamine dihydrofluoride;
N-cocoyl N,N,N', N', N'-pentamethyl-1,3-propane diammonium dichloride or dimethosulfate;
N-oleyl N,N', N'-tris(3-hydroxypropyl)-1,3-propanediamine dihydrofluoride;
N-stearyl N,N', N'-tris(2-hydroxyethyl) N,N'-dimethyl-1,3-propanediamonium dimethylsulfate;
N-palmityl N,N', N'-tris(3-hydroxypropyl)-1,3-propanediamine dihydrobromide;
N-(stearyloxyproply) N,N', N'-tris(3-hydroxypropyl)1,3-propanediammonium diacetate;
N-tallowyl N-(3-aminopropyl)1,3-propanediamine trihydrochloride;
N-oleyl N-[N'', N'' bis(2-hydroxyethyl)3-aminopropyl]N', N'-bis(2hydroxyethyl)3-aminopropyl]N', N'-bis (2-hydroxyethyl)1,3 diaminopropane trihydrofluoride.
1-[N-hydrogenated tallowylaminopropyl]-pentahydropyridinium dihydrochloride; and
1-[N-stearylaminopropyl]-5-(hydroxyethyl)-tetrahydropyridinium sulfate.

A series of concentrated liquid fabric softeners have the compositions given hereinafter are prepared in a conventional manner:

| INGREDIENTS | PARTS BY WEIGHT | | | | | | |
|---|---|---|---|---|---|---|---|
| Examples: | II | III | IV | V | VI | VII | VIII |
| N-oleyl-N,N',N'-tri(3-hydroxypropyl)-1,3-propanediamine dihydrofluoride | 8 | | | | | 20 | |
| N-tallowyl-N,N', N'-tri(2-hydroxyethyl)-1,3-propanediamine dihydrochloride | | 36 | | | 16 | | |
| N-soybean alkyl-1,3-propanediammonium sulfate | | | 22 | | | | |
| N-cocoyl-N,N,N',N',N'-pentamethyl-1,3-propanediammonium dimethosulfate | | | | 10 | | | 12 |
| Ditallowyldimethylammonium chloride | 6 | | 10 | 6 | 8 | | 5 |
| Glycerol monostearate | 12 | 12 | | | 4 | | 14 |
| Stearyl acetate | | | | | 8 | | |
| Stearylglyceryl mono-ether | | | | 12 | | | |
| N-stearyl methacrylamide | | | | | | 18 | |
| Water and minor ingredients | | | | balance to 100 | | | |

The compositions of examples II through VIII show excellent phase stability, homegeneity, pourability and dispersability after a prolonged storage.

Substantially comparably performing fabric-softening compositions result from the compositions of examples II, VI and VIII wherein the glycerol monostearate is substituted by an equivalent amount of a nonionic softening component selected from the group of: xylitol monopalmitate, pentaerythritol monostearate, sucrose monostearate, batyl alcohol, ethyleglycol monoether, octadecylvinylether, cocoylsorbitolmonoether, tallowyldiethyleneglycol ether, palmityloxypropyloxypropanol; and arachidylpenterythritol monoether.

A series of additional liquid fabric softeners in accordance with the invention herein are prepared thereby using the sequence of processing steps and manufacturing conditions set forth in example I above.

| EXAMPLES | IX | X | XI | XII | XII | XIV | XV |
|---|---|---|---|---|---|---|---|
| N-hydrogenated tallowyl N,N',N'-tri hydroxyethyl)1,3-propanediamine dihydrochloride | — | — | — | 6 | — | 16 | 18 |
| N-soybean alkyl-1,3-propane diammonium sulfate | 16 | — | — | — | — | 6 | — |
| Glycerol monostearate | 12 | 12 | 12 | — | — | — | 14 |
| Stearyl glyceryl monoether | — | — | — | 14 | — | 18 | — |
| N-tallowyl N-(3-aminopropyl)1,3-propanediamine trihydrochloride | — | 18 | — | — | 22 | — | — |
| Polyram L 200 ®[1] dihydrobromide | — | — | 16 | — | — | — | — |
| Di-hydrogenated tallowyl dimethyl ammonium chloride | — | — | 4 | 4 | — | — | — |
| N-(stearyloxypropyl)N,N',N'-tri(3-hydroxypropyl)1,3-propanediammonium diacetate | — | — | — | 12 | — | — | — |
| 1-methyl 1-(tallowylamido)ethyl-2-tallowyl 4,5-dihydroimidazolinium methosulfate | — | — | — | — | 6 | — | 8 |
| Water and minor ingredients | | | | Balance to 100 | | | |

[1]Polyram L 200 ® has the chemical formula:

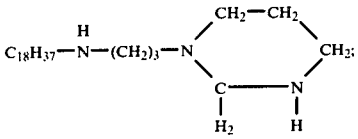

it is sold by Pierrefitte-Auby.

What is claimed is:

1. A concentrated liquid fabric softener having improved pourability and water-dispersability characteristics comprising from about 25% to about 55% by weight of an active system comprised of a fabric-substantive agent and a fabric-softening component, the fabric-substantive agent being selected from the group of:

(1) a compound having the formula

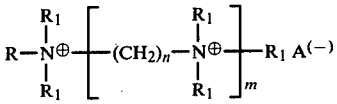

wherein R is selected from an alkyl or alkenyl group having from 10 to 24 carbon atoms in the alk(en)yl chain, and R—O—$(CH_2)_{n1}$—; the $R_1$'s which may be the same or different each represent hydrogen, -$(C_2H_4O)_pH$, -$(C_3H_6O)_qH$, -$(C_2H_4O)_p$, $(C_3H_6O)_q$, H, a $C_{1-3}$ alkyl group or the group—$(CH_2)_{n2}$—$N(R')_2$, wherein R' is selected from hydrogen,—$(C_2H_4O)_p$-H,—$(C_3H_6O)_qH$,—$(C_2H_4O)_p$, $(C_3H_6O)_q$, H and a $C_{1-3}$ alkyl group, where n, $n_1$ and $n_2$ each represent an integer from 2 to 6, m is an integer from 1 to 5, each p, q and (p'+q') may be 0 or a number such that (p+q+p'+q') does not exceed 25, and, if in the salt or partial salt form, $A^{(-)}$ represents one or more anions having total charge balancing that of the nitrogen atom(s);

(2) an alkylpyridinium salt wherein the alkyl chain has from about 10 to 24 carbon atoms; and (3) mixtures thereof; with the proviso that the fabric-substantive agent has a water-solubility of more than about 5% by weight at pH 2.5 and 20° C., the fabric-softening component being selected from the group of:

(a) a quaternary ammonium salt having the formula

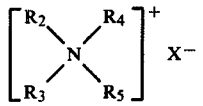

wherein $R_2$ and $R_3$ represent hydrocarbyl groups having from 12 to 24 carbon atoms, $R_4$ and $R_5$ represent hydrocarbyl groups having from 1 to 4 carbon atoms, and X is an anion;

(b) an alkylimidazolinium salt having the formula

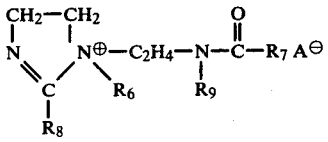

wherein $R_6$ is a $C_{1-4}$ alkyl group, $R_9$ is hydrogen or a $C_{1-4}$ alkyl group, $R_8$ is a $C_{8-25}$ alkyl group; and $R_7$ is a $C_{9-25}$ alkyl group; and $A^{\ominus}$ is an anion;

(c) a fatty ester of mono- or polyhydric alcohols having from 1 to about 24 carbon atoms in the hydrocarbon chain, and mono- or polycarboxylic acids having from 1 to about 24 carbon atoms in the hydrocarbon chain with the provisos that the total number of carbon atoms in the ester is equal to or greater than 16 and that at least one of the hydrocarbon radicals in the ester has 12 or more carbon atoms;

(d) ethers of fatty alcohols having from 10 to 24 carbon atoms in the alkyl chain and mono- or polyalcohols having from 2 to 8 carbon atoms, whereby the total number of carbon atoms in the ether is equal to or greater than 16;

(e) compounds of the formula $R_{10}$—X—$R_{11}$ wherein $R_{10}$ has from about 12 to 24 carbon atoms and $R_{11}$ from 1 to 6 carbon atoms in the alkyl chain which can be interrupted by not more than one oxygen link, and X stands for sulfur, $$-\underset{\underset{O}{\|}}{C}-NH-;\ \text{or}\ -NH-\underset{\underset{O}{\|}}{C}-;$$

and (f) mixtures thereof, whereby the weight of the fabric-substantive agent to the fabric-softening component is in the range from about 6:1 to about 1:4; and a liquid carrier.

2. The composition in accordance with claim 1 wherein the fabric-substantive agent is present in an amount from about 50% to about 85% by weight and the fabric-softening component selected from (a) and (b) is present in an amount from about 15% to about 50% by weight, the amounts of the components being expressed by reference to their sum.

3. The composition in accordance with claim 1 wherein the fabric-substantive agent is present in an amount from about 25% to about 85% by weight and the fabric-softening component selected from (c), (d) and (e) is present in an amount from about 15% to about 75% by weight, the amounts of the components being expressed by reference to their sum.

4. The composition in accordance with claim 1 where $R_1$ in the fabric-substantive agent is $-(C_2H_4O)_p$ H or $-(C_3H_6O)_qH$ or $-(C_2H_4O)_p$, $(C_3H_6O)_q$, where each of p, q, and (p'+q') are 1 or 2.

5. The composition in accordance with claim 1 wherein the fabric-substantive agent is present in an amount from about 65% to about 80% by weight and the fabric-softening component selected from (a) and (b) is present in an amount from about 20% to about 35% by weight, the amounts of the components being expressed by reference to their sum.

6. The composition in accordance with claim 1 wherein the fabric-substantive agent is present in an amount from about 35% to about 65% by weight and the fabric-softening component selected from (c), (d) and (e) is present in an amount from about 65% to about 35% by weight, the amounts of the components being expressed by reference to their sum.

7. The composition in accordance with claim 1 wherein the fabric-substantive agent represents from about 25% to about 65% by weight and wherein the fabric-softening component is represented by a binary system containing from about 8% to about 35% of the fabric-softening component selected from (a) and (b) and from about 15% to about 60% of the fabric-softening component selected from (c), (d) and (e), the amounts of the components being expressed by reference to their sum.

8. The composition in accordance with claim 1 wherein the fabric-substantive agent is selected from the group consisting of:

N-tallowyl, N,N', N'-tris(2-hydroxyethyl)1,3-propanediamine di-hydrochloride:

N-soybean alkyl-1,3-propane diammonium sulfate;

N-stearyl-N,N'-di(2-hydroxyethyl)-N'-(3-hydroxypropyl)-1,3-propanediamine dihydrofluoride;

N-cocoyl N,N,N',N',N'-pentamethyl-1,3-propane diammonium dichloride or dimethosulfate;

N-oleyl N,N',N'-tris(3-hydroxypropyl)-1,3-propanediamine dihydrofluoride;

N-stearyl N,N',N'-tris(2-hydroxyethyl) N,N'-dimethyl-1,3-propanediamonium dimethylsulfate;

N-palmityl N,N',N'-tris(3-hydroxypropyl)-1,3-propanediamine dihydrobromide;

N-(stearyloxypropyl) N,N', N'-tris(3-hydroxypropyl)1,3-propanediammonium diacetate;

N-tallowyl N-(3-aminopropyl)1,3-propanediamine trihydrochloride;

N-oleyl N- [N'', N'' bis(2-hydroxyethyl)3-aminopropyl]N', N'-bis(2-hydroxyethyl)1,3 diaminopropane trihydrofluoride.

1-[N-hydrogenated tallowylaminopropyl]-pentahydropyridinium dihydrochloride;

1-[N-stearylaminopropyl]-5-(hydroxyethyl)-tetrahydropyridinium sulfate; and $C_{16-18}$ alkylpyridinium chloride or bromide.

9. The composition in accordance with claim 8 wherein the fabric-softening component is selected from the group consisting of:

ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; dihexadecyl dimethyl ammonium bromide; ditallow dipropyl ammonium bromide; di(coconutalkyl)dimethyl ammonium chloride, 1-methyl-1-[(tallowylamido-)ethyl]-2-tallowyl-4,5-dihydroimidazolinium methyl sulfate; and 1-methyl-1-[(palmitoylamido) ethyl]-2-octadecyl-4,5-dihydroimidazolinium chloride.

10. The composition in accordance with claim 8 wherein the fatty ester is selected from the group consisting of: stearyl acetate; palmityl dilactate; cocoyl isobutyrate; oleyl maleate; oleyl dimaleate; tallowyl propionate; xylitol monopalmitate; pentaerythritol monostearate; sucrose monostearate; glycerol monostearate; ethylene glycol monostearate; sorbitan monostearate; sorbitan palmitate; sorbitan monolaurate; sorbitan monomyristate; sorbitan monobehenate; sorbitan monooleate; sorbitan dilaurate; sorbitan distearate; sorbitan dibehenate and sorbitan dioleate.

11. The composition in accordance with claim 8, wherein the ethers of fatty alcohols are selected from the group consisting of: batyl alcohol; behenyl ethyleneglycolmono ether; octadecyl vinyl ether; cocoyl sorbityl mono-ether; tallowyl diethylenglycol ether; palmityloxypropyloxypropanol; and arachidylpentaerythritol mono-ether.

12. The composition in accordance with claim 8 wherein the compound having the formula $R_{10}$-X-$R_{11}$ is selected from the group consisting of: N-stearyl methacrylamide; stearyl vinyl sulfide; N-palmityl-2-hydroxyethylamide and N-tallowyl-3-hydroxypropylamide.

13. The composition in accordance with claim 7 wherein the fabric-substantive agent represents from about 30% to about 45% by weight, the fabric-softening component selected from (a) and (b) from about 15% to about 25% by weight and the fabric softening component selected from (c), (d) and (e) from about 30% to about 55% by weight, the amounts of the components being expressed by reference to their sum.

14. The composition in accordance with claim 7 wherein the weight ratio of the fabric-softening component selected from (a) and (b) to the fabric-softening component selected from (c), (d) and (e) is equal to or smaller than one.

15. The composition in accordance with claim 14 wherein the weight ratio of the fabric-softening component selected from (a) and (b) to the fabric-softening component selected from (c), (d) and (e) is equal to or smaller than 0.7.

* * * * *

UNITED STATES PATENT AND TRADEMARK OFFICE

CERTIFICATE OF CORRECTION

PATENT NO. : 4,155,855

DATED : May 22, 1979

INVENTOR(S) : Pierre C.E. Goffinet et al

It is certified that error appears in the above-identified patent and that said Letters Patent are hereby corrected as shown below:

On the title page, the following priority information should be inserted:

Foreign Application Priority Data

July 6, 1977 United Kingdom 28300/77

Column 7, line 29, "esters" should be --ethers--.

Column 8, line 1, "hereinbelow" should be --hereinbefore--.

Column 8, line 27, "esters" at second occurrence should be --ethers--.

Column 8, line 41, "silicons" should be --silicones--.

Column 13, line 28, claim 5 should depend from claim 2.

Column 13, line 35, claim 6 should depend from claim 3.

Signed and Sealed this

*Twelfth* Day of *February 1980*

[SEAL]

*Attest:*

SIDNEY A. DIAMOND

*Attesting Officer*

*Commissioner of Patents and Trademarks*